United States Patent [19]

Roumeguere

[11] Patent Number: 4,768,447

[45] Date of Patent: Sep. 6, 1988

[54] FIRE-BRICK FOR REFRACTORY PROTECTION WALLS OF OVENS, FURNACES AND COMBUSTION CHAMBERS

[75] Inventor: Pascal Roumeguere, Contes, France

[73] Assignee: Compagnie D'Exploitation Thermique-Cometherm, Marseilles, France

[21] Appl. No.: 66,852

[22] Filed: Jun. 25, 1987

[51] Int. Cl.[4] ..... F23M 9/00

[52] U.S. Cl. ..... 110/325; 110/336; 110/338

[58] Field of Search ..... 110/331, 332, 336, 337, 110/338, 339, 322, 323, 324, 325; 122/511, 512; 52/506, 509, 512

[56] References Cited

U.S. PATENT DOCUMENTS

| | | | |
|---|---|---|---|
| 2,144,598 | 1/1939 | Brinckerhoff et al. | 110/336 |
| 2,463,217 | 3/1949 | Tonneson | 110/336 X |
| 2,553,393 | 5/1951 | Weber | 110/336 X |
| 3,343,319 | 9/1967 | Reintjes | 110/336 X |
| 4,136,625 | 1/1979 | Corbet et al. | 110/339 X |
| 4,157,001 | 6/1979 | Pickles | 110/336 X |

*Primary Examiner*—Steven E. Warner

*Attorney, Agent, or Firm*—Collard, Roe & Galgano

[57] ABSTRACT

A method of building refractory protection walls of furnaces, ovens or combustion chambers, notably but not exclusively for boilers for incinerating garbage and refuse, is proposed for protecting the hearth walls by means of a refractory wall (4) consisting of a plurality of shaped fire-bricks (5) each provided with at least one blind recess (6, 11) disposed at the level of the fixing means of the panel (1) to be protected which consist of fixing studs (7) projecting from the panel surface and adapted to engage the corresponding blind recesses (6, 11) so that each fire-brick (5) is suspended from these studs (7) and self-locked in position by at least the next overlying fire-brick.

4 Claims, 1 Drawing Sheet

FIRE-BRICK FOR REFRACTORY PROTECTION WALLS OF OVENS, FURNACES AND COMBUSTION CHAMBERS

BACKGROUND OF THE INVENTION

The present invention relates to a method of building refractory protection walls of ovens, furnaces and combustion chambers, and to a fire-brick for carrying out said method.

This invention is applicable notably but not exclusively to the construction of boilers or furnaces for protecting the hearth walls thereof. More particularly, the present invention is intended for protecting boilers in which the hearth walls are provided with tubular panels, notably in the case of town refuse or garbage incineration boilers.

THE PRIOR ART

A boiler of this type is well known nowadays which comprises essentially a combustion chamber which, in the case of an incineration plant, permits of burning up household and industrial refuse and have their inner walls equipped with heat regenerators for recovering the potential thermal energy stored in the refuse.

In fact, some known combustion chambers have their inner walls lined with so-called tubular panels made from tubular elements and fins welded thereto, a heat-conveying fluid being caused to flow through the panels heated during the combustion.

However, to protect such tubular panels from severe heat- and mechanical stress and from the attack of chemical and abrasive substances, they must be protected by a refractory or fire wall warranting a longer useful life of the structure.

In the conventional method of building tubular panels, said tubes are spaced from one another but not assembled through their fins, so that suitably shaped fire-bricks can be disposed between the tubes for completing the protection fire-wall. Now this method is no more applicable to panels consisting of an assembly of tubes and fins welded thereto since it is not possible to insert fire-bricks between a pair of adjacent tubes due to the presence of said fins.

In a known attempt to palliate this inconvenience, fire-bricks and refractory plates provided with transverse holes have been proposed so that the bricks can be fitted to the tubular panels by means of fastening means such as screws, rivets or T-shaped locking lugs extending therethrough.

This solution is objectionable because on the one hand it impairs the strength of the fire-bricks, due to the presence of the through-holes, and on the other hand each fixation hole must subsequently be stopped.

SUMMARY OF THE INVENTION

It is primary object of the present invention to provide a method of building refractory inner protection walls for furnaces, ovens or combustion chambers, which avoids the inconveniences of prior art structures and on the one hand neither impairs the mechanical strength of the fire-bricks, nor requires any sealing or stopping operation when fitted in position.

It is another object of the present invention to provide a fire-brick for protecting tubular panels, this brick having a shape consistent with the panel configuration and a plain, solid surface on the boiler or furnace side, and adapted to be easily fitted to the wall panels.

Another object of the present invention consists in providing an improved method of building refractory panels for protecting the walls of furnaces, ovens and combustion chambers by means of fire-bricks having a configuration such that they can be fitted in staggered relationship to prevent any air-flue effect through the brick sealing joints.

Furthermore, this invention is directed to provide a method of building refractory protection walls by using fire-bricks which are characterised by a reliable, efficient fluid-tightness.

A complementary object of the present invention consists in providing a method of building refractory protection walls from fire-bricks so shaped that they are self-fixing and self-locking in the final structure.

Other objects and advantages of the present invention will appear as the following description proceeds which is given by way of example, not of limitation.

In this respect, the method of building refractory walls for the protection of furnaces, ovens and combustion chambers according to the present invention, notably but not exclusively for household refuse incineration boilers for protecting the hearth walls, notably those equipped with tubular panels made from metal tubes with welded fins, said refractory walls consisting each of a plurality of shaped fire-bricks, is characterised in that:

each fire-brick is provided with at least one blind recess positioned to register with matching fixing means projecting from the panels, the fire-brick fixing means consist of a plurality of fixing studs having dimensions consistent with the blind recesses formed in the fire-bricks, and each fire-brick is suspended from the corresponding fixing stud by gravity and self-locked in position at least by the adjacent or next overlying brick.

To facilitate the carrying out of the method of the present invention, each fire-brick of the refractory structure for protecting tubular panels consisting of a cluster of tubes assembled by means of welded fins has a volumetric configuration consistent with the panels, with an inner face and an outer face, and is characterised in that it comprises on its inner face at least one blind recess of which the longitudinal axis extends transversely and is inclined with respect to said inner face, whereby the brick is self-locking by gravity.

A clearer understanding of the present invention will be had from the following description given with reference to the attached drawings.

THE DRAWINGS

DESCRIPTION OF THE PREFERRED EMBODIMENT

The present invention is directed to the building of refractory walls for protecting furnaces, ovens or combustion chambers consisting as a rule of a hearth in which the combustion takes place and having its walls provided with a heat exchanger capable of collecting the heat released by the combustion for reheating a heat conveying fluid for the purpose of delivering heat to another device.

Furnaces, ovens or combustion chambers of this type are used in general but not exclusively in boilers for incinerating town or household refuse or garbage, as well as industrial refuse or waste.

Figure 1:
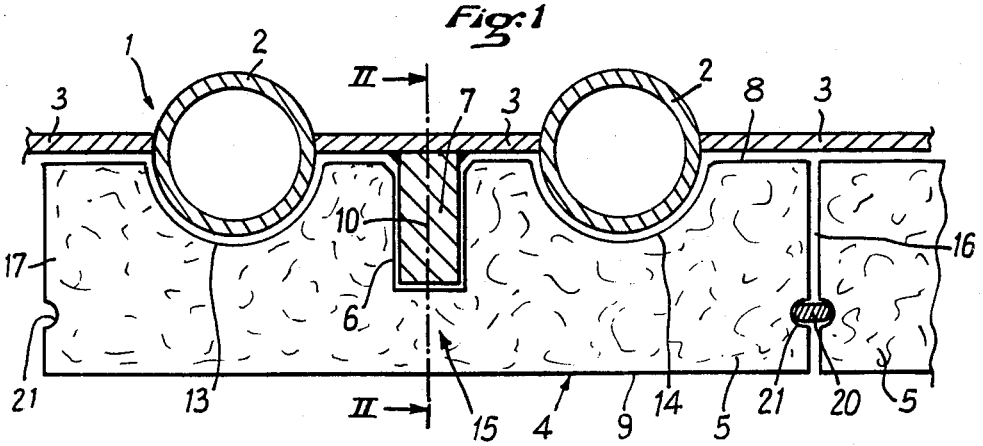
FIG. 1 is a fragmentary section taken across a combustion chamber equipped with a tubular panel protected according to the teachings of the present invention.

As clearly shown notably in FIG. 1, the hearth walls are provided with tubular panels 1 consisting in turn of tubes 2 interconnected by welded fins 3 and intended for circulating the heat-conveying fluid.

In the method of the present invention the refractory wall 4 consists of a plurality of shaped fire-bricks 5, as follows:

each fire-brick 5 comprises at least one blind recess 6 disposed at the level of the fixing means contemplated;

the panel 1 to be protected is provided with a plurality of projecting fixing studs 7 matching with and adapted to engage said blind recesses 6 of fire-bricks 5, each fire-brick 5 is suspended from the corresponding fixing stud or studs 7 and thus held in position by gravity, the fire-brick being furthermore self-locked at least by the overlying adjacent fire-brick 5.

Figure 2:
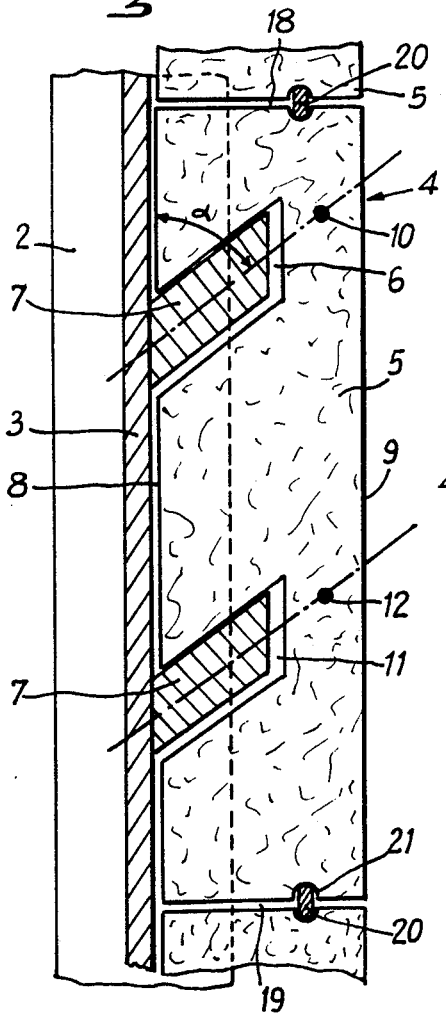
FIG. 2 is a longitudinal section taken along the line II—II of FIG. 1.

As shown in FIGS. 1 and 2, the fire-bricks 5 have a volumetric shape consistent with the panel 1 and comprise an inner face 8 and an outer face 9.

The inner face 8 of each fire-brick 5 is shaped to accomodate the tubes 2 of tubular panel 1 and the outer face 9 is part of the surface of the refractory protection wall, on the hearth side.

According to the present invention, each fire-brick 5 has formed on it inner face 8 at least one blind recess 6 having a longitudinal axis 10 extending across the fire-brick thickness and inclined at an angle $\alpha$ to said inner face 8.

According to a preferred form of embodiment of the present invention, this angle $\alpha$ will advantageously lie in the range of 45°-90°, and the longitudinal axis 10 will extend upwardly to impart the self-locking feature to the fire-brick 5 by mere gravity, as actually shown in FIG. 2.

In another preferred form of embodiment, each fire-brick 5 has two blind recesses 6, 11 formed therein, the longitudinal axes 10, 12 respectively of which being disposed in a common axial plane substantially at right angles to the inner face 8. Furthermore, these axes 10, 12 are substantially parallel to each other. Thus, when fitting the fire-brick in position, any undesired pivoting movement thereof with respect to its fixing stud 7 will be safely prevented.

Moreover, as also shown in FIG. 1 the inner face 8 of fire-brick 5 has two spaced grooves 13, 14 of semi-circular cross-sectional configuration formed therein. The distance between centres of these grooves 13, 14 corresponds substantially to that of said tubes 2. In this case, the blind recess or recesses 6, 11 are disposed in the thickest area 15 of the fire-brick, for example substantially midway of said grooves 13, 14.

Figure 3:
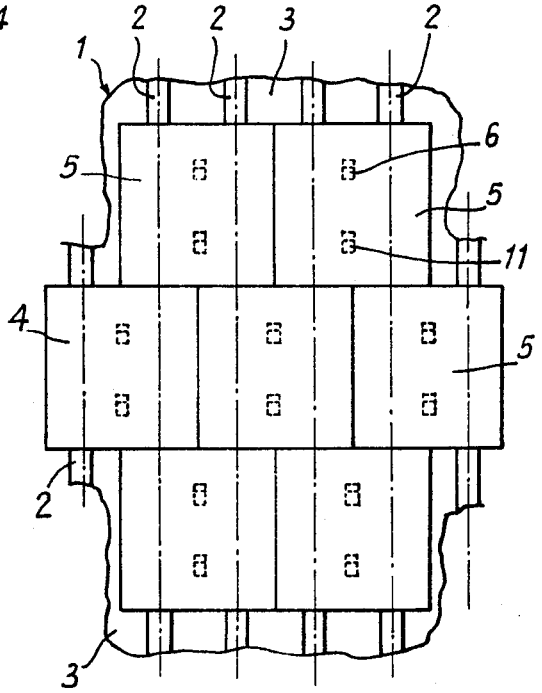
FIG. 3 is a fragmentary view showing one face of a refractory protection wall according to the instant invention.

In fact, according to the method of the present invention, the blind recesses 6, 11 as well as the corresponding fixing studs 7 provided for suspending and self-locking the fire-bricks 5 are disposed in staggered relationship to prevent any undesired "flue effect" from developing in the jointing of the fire-bricks, as shown more particularly in FIG. 3.

This arrangement is made possible notably by the fact that each fire-brick 5 covers a pair of adjacent tubes 2 and is suspended from, and secured by, the corresponding fixing studs 7 projecting from the fin 3 disposed between, and welded to, said pair of adjacent tubes 2.

The above-described form of embodiment of fire-brick 5 is perfectly suitable to this staggered fitting method.

However, other fire-brick sizes may be contemplated, notably when it is desired that each brick covers three tubes or more, without departing from the basic principle of the invention.

When carrying out the method of the present invention by building a refractory protection wall structure consisting of a plurality of fire-bricks 5, each fire-brick is provided with a pair of blind recesses 6, 11 disposed substantially along a common vertical axis, and fixing studs 7 having a configuration consistent with that of said blind recesses are welded to the fins 3 of tubular panels 1 according to the dimensions of each fire-brick 5.

Thus, by welding the fixing studs 7 to said fins 3, the mechanical strength of tubes 2 constituting the panels 1 is not impaired. However, it is quite possible to weld these fixing studs 7 to the tube generatrices, provided that the bricks and their recesses are designed accordingly.

Finally, when building a refractory protection wall separating the combustion chamber from the tubular panel according to the method of the present invention, the fluid-tightness between adjacent fire-bricks 5 is obtained by providing a refractory seal 20 between each top, bottom and lateral face 16 - 19 of fire-bricks 5.

For this purpose, each top, bottom and lateral face 16 - 19 of fire-bricks 5 has a relatively shallow groove 21 formed therein for receiving this refractory seal 20.

This seal 20 may consist of any suitable refractory material preserving a certain resiliency even at high temperature, as will readily occur to those conversant with the art.

Of course, other forms of embodiment may be devised for the present invention without departing from the basic principles thereof.

I claim:

1. A fire-brick for use in a refractory wall composed of a plurality of shaped fire-bricks for the protection of a hearth wall, the hearth wall being provided with panels composed of a cluster of tubes assembled by welded fins and having a plurality of fixing studs, said fire-bricks having a volumetric configuration consistent with said panel, each fire-brick having an inner face and an outer face, and comprising on its inner face at lease one blind recess having a longitudinal axis extending across and inclined to said inner face, the fixing studs of said panels matching with and being adapted to engage the blind recesses of the plurality of fire-bricks composing the refractory wall, each fire-brick being suspended from corresponding fixing studs to be held in position by gravity and self-locked at least by the overlying adjacent fire-brick of the refractory wall.

2. The fire-brick of claim 1, wherein each said fire-brick has a top, bottom and lateral face and a groove is formed in each said face for engagement by a refractory seal.

3. The fire-brick of claim 1, wherein a pair of spaced blind recesses are provided having their longitudinal axes disposed in substantially co-planar parallel relationship and at right angles to said inner face of the fire-brick.

4. The fire-brick of claim 3, wherein the inner face of each said fire-brick has a pair of grooves corresponding to said panel tubes and having a distance between centers corresponding substantially to that of said tubes, and said blind recesses being located in the area of major thickness of said fire-brick and being equally spaced from said grooves.

* * * * *